US006250199B1

(12) United States Patent
Schulte et al.

(10) Patent No.: US 6,250,199 B1
(45) Date of Patent: Jun. 26, 2001

(54) SUBSEA POWER MODULE

(75) Inventors: Clarence Afton Schulte; Paul Nelson Stanton, both of Houston, TX (US)

(73) Assignee: Deep Oil Technology, Incorporated, Houston, TX (US)

( * ) Notice: Subject to any disclaimer, the term of this patent is extended or adjusted under 35 U.S.C. 154(b) by 0 days.

(21) Appl. No.: 09/300,101

(22) Filed: Apr. 27, 1999

(51) Int. Cl.[7] ..... F15B 21/04
(52) U.S. Cl. ..... 91/4 R; 60/398; 60/453
(58) Field of Search ..... 91/4 R; 60/398, 60/453

(56) References Cited

U.S. PATENT DOCUMENTS 3,100,965 * 8/1963 Blackburn ..... 91/4 R
3,803,847 * 4/1974 McAlister ..... 91/4 R
5,417,063 * 5/1995 Somers ..... 91/4 R
5,551,237 * 9/1996 Johnson ..... 60/398 X

* cited by examiner

*Primary Examiner*—Hoang Nguyen
(74) *Attorney, Agent, or Firm*—D. Neil LaHaye

(57) ABSTRACT

A subsea hydraulic control module that is totally enclosed such that the hydraulic fluid does not contact the seawater. The majority of the power for the module comes from the hydrostatic pressure of the sea itself. Two oil-over-seawater actuators each have an internal piston that separates the oil from the seawater. Each actuator is provided with two solenoid valves that control the flow of seawater. A fluid line and one solenoid valve on the seawater side of each actuator is in fluid communication with a seawater recovery reservoir. These two valves are also in fluid communication with each other through a common fluid line to the seawater reservoir. The remaining solenoid valve on the seawater side of each actuator may be selectively opened or closed to the ambient seawater. A hydraulic line on the oil side of each actuator is in fluid communication with the equipment to be controlled. The hydraulic lines from each actuator enter the equipment to be controlled on opposite sides of the equipment to allow control of the equipment. The solenoid valves are opened and closed in selected combinations to open, close, or maintain the equipment in selected operating positions.

3 Claims, 3 Drawing Sheets

SUBSEA POWER MODULE

BACKGROUND OF THE INVENTION

1. Field of the Invention

The invention is generally related to the control of subsea equipment and more particularly to a power module for control of hydrocarbon production equipment in deep water.

2. General Background

In the drilling and production operations for hydrocarbons offshore, it is necessary to position equipment such as a blowout preventer or subsea tree at or near the sea floor. Three different types of control systems have been accepted and used in offshore drilling and completion operations.

The direct hydraulic control system was the first system ever used offshore. All power for the controls is located above the water surface, with hydraulic lines that lead down to the equipment at the sea floor. Its advantage is high reliability, independent control of selected functions, and relatively low installation cost. The main disadvantage is slow response time, which makes it unsuitable for deep-water applications that require fast response times.

The piloted hydraulic control system uses pilot line pressure to open and close small volume valves that control flow from high-pressure accumulators. The flow from accumulators operates blowout preventers or other valves on the ocean floor. This system uses a smaller control bundle and operates much faster than a direct hydraulic control system. The system operates faster because it uses smaller volumes and it dumps the excess fluid at the ocean floor after each function is performed. The main advantages are speed and reliability. The umbilical line is smaller, takes up less room on the rig, and costs less than a direct hydraulic umbilical line. The piloted system performs well up to about three thousand feet of water depth. The disadvantages are that the system requires accumulators to function and the number of accumulators needed increases as the water depth increases. The system requires a hydraulic supply line to recharge the accumulators after operating the system because it dumps the fluid at the ocean floor.

The electro-hydraulic control system operates solenoid valves to direct high pressure or high volume from the supply accumulators. The supply accumulators will operate blowout preventers or valves on the ocean floor. The advantages are fast operation and a small umbilical with one supply line. The disadvantages are that the system requires accumulators to function and the number of accumulators increases as the water depth increases. The electro-hydraulic control system works in deep water but requires a very large volume of accumulators. This system requires a hydraulic supply line to recharge the accumulators after operating the system. It also dumps its hydraulic fluid at the ocean floor after functioning.

The present state of the art requires huge numbers of accumulators to provide hydraulic power controls for the deeper water depths that have become more common place in drilling/producing hydrocarbons. The present state of the art also presents a potential pollution problem when non-biodegradable hydraulic fluids are used. Thus, it can be seen that the present state of the art leaves a need for a means of supplying hydraulic power to sub sea controls at deeper water depths that does not require an accumulator volume that increases with water depth and that does not present pollution concerns.

SUMMARY OF THE INVENTION

The invention addresses the above need. What is provided is a subsea hydraulic control module that is totally enclosed such that the hydraulic fluid does not contact the seawater. The majority of the power for the module comes from the hydrostatic pressure of the sea itself. Two oil-over-seawater actuators each have an internal piston that separates the oil from the seawater. Each actuator is provided with two solenoid valves that control the flow of seawater. A fluid line and one solenoid valve on the seawater side of each actuator is in fluid communication with a seawater recovery reservoir. These two valves are also in fluid communication with each other through a common fluid line to the seawater reservoir. The remaining solenoid valve on the seawater side of each actuator may be selectively opened or closed to the ambient seawater. A hydraulic line on the oil side of each actuator is in fluid communication with the equipment to be controlled. The hydraulic lines from each actuator enter the equipment to be controlled on opposite sides of the equipment to allow control of the equipment. The solenoid valves are opened and closed in selected combinations to open, close, or maintain the equipment in selected operating positions. Air lines are used to remove seawater from the seawater recovery reservoir by circulating air down one line to lift seawater up a return line.

BRIEF DESCRIPTION OF THE DRAWINGS

For a further understanding of the nature and objects of the present invention reference should be made to the following description, taken in conjunction with the accompanying drawings in which like parts are given like reference numerals, and wherein.

DETAILED DESCRIPTION OF THE PREFERRED EMBODIMENT

Figure 1:
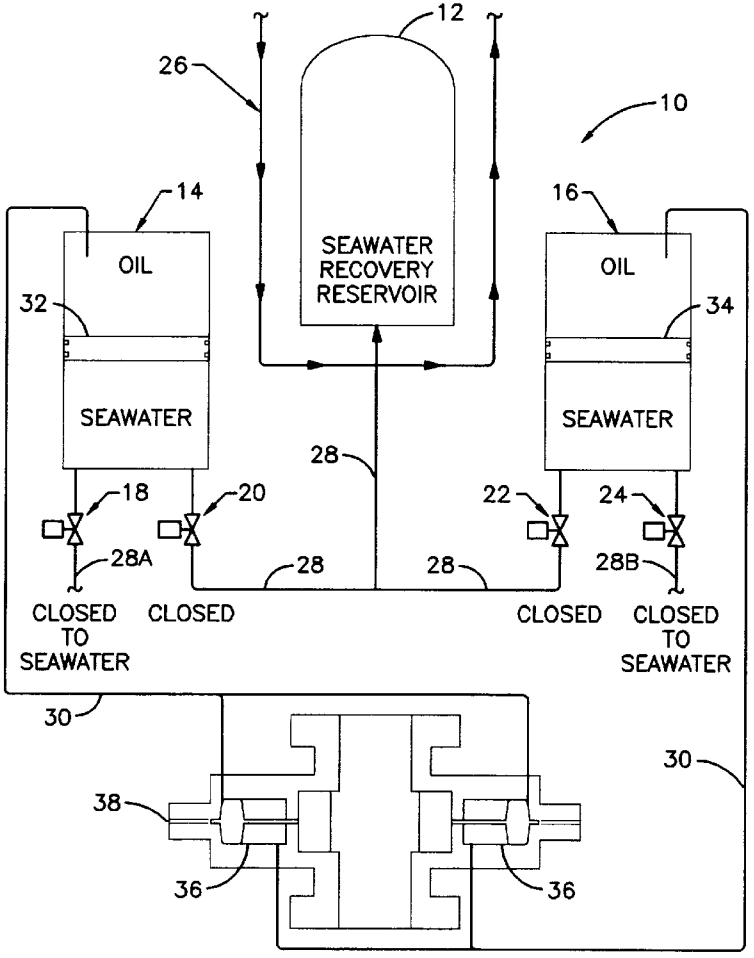
FIG. 1 is a schematic illustration of the invention.

Referring to the drawings, it is seen in FIG. 1 that the invention is generally indicated by the numeral 10. Subsea power module 10 is generally comprised of a seawater recovery reservoir 12, first and second oil-over-seawater actuators 14 and 16, a plurality of solenoid valves 18, 20, 22, and 24, air line 26, water line 28, and hydraulic fluid lines 30.

The reservoir 12 is in fluid communication with air line 26 and receives air that can be vented to one atmosphere of pressure. Air is supplied through the air line 26 from a source not shown above the water surface.

The oil-over-seawater actuators 14 and 16 are closed containers with each having a piston 32 and 34 respectively that moves inside the container and prevents the oil and seawater from mixing.

Water line 28 is in fluid communication with the water side of each actuator 14 and 16 and vents to the reservoir 12 via air line 26.

Hydraulic fluid line 30 is in fluid communication with the oil side of each actuator 14 and 16 and the actuating mechanism 36 of the equipment 38 to be operated by the invention. Equipment 38 is illustrated as a blow out preventer but it should be understood that the invention may be used with any type of equipment that is suitable for on-off operation.

Water line 28A is in fluid communication at a first end with the water side of first actuator 14 and is open at the second end to the seawater. First solenoid valve 18 is placed in water line 28A between the first and second ends to selectively control the flow of seawater there through.

Water line 28B is in fluid communication at a first end with the water side of second actuator 16 and is open at the second end to the seawater. Fourth solenoid valve 24 is placed in water line 28B between the first and second ends to selectively control the flow of seawater there through.

Second solenoid valve 20 is placed in water line 28 adjacent first actuator 14 before the T-junction that leads to reservoir 12. Third solenoid valve 22 is placed in water line 28 adjacent second actuator 16 before the T junction that leads to reservoir 12. Thus, second and third solenoid valves 20 and 22 are tied together in the same water line and vent back to the reservoir 12.

In operation, subsea power module 10 is used to control a piece of equipment such as a blow out preventer as follows.

Figure 2:
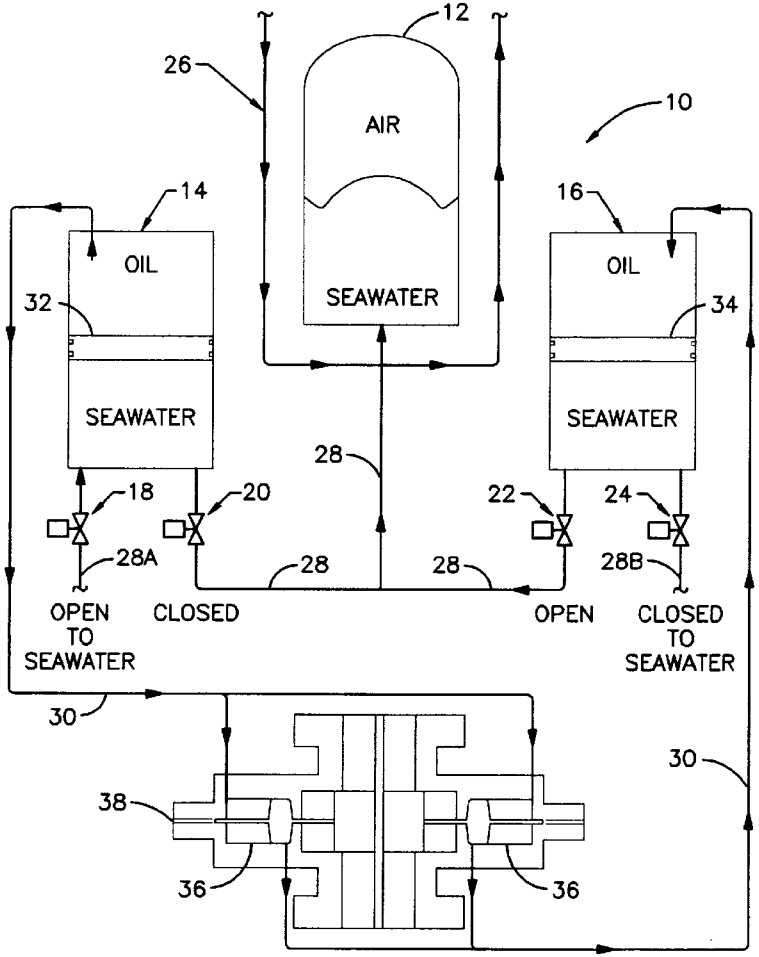
FIG. 2 is a schematic illustration of the invention that shows the valve configuration and flow required to open a blow out preventer.
Figure 3:
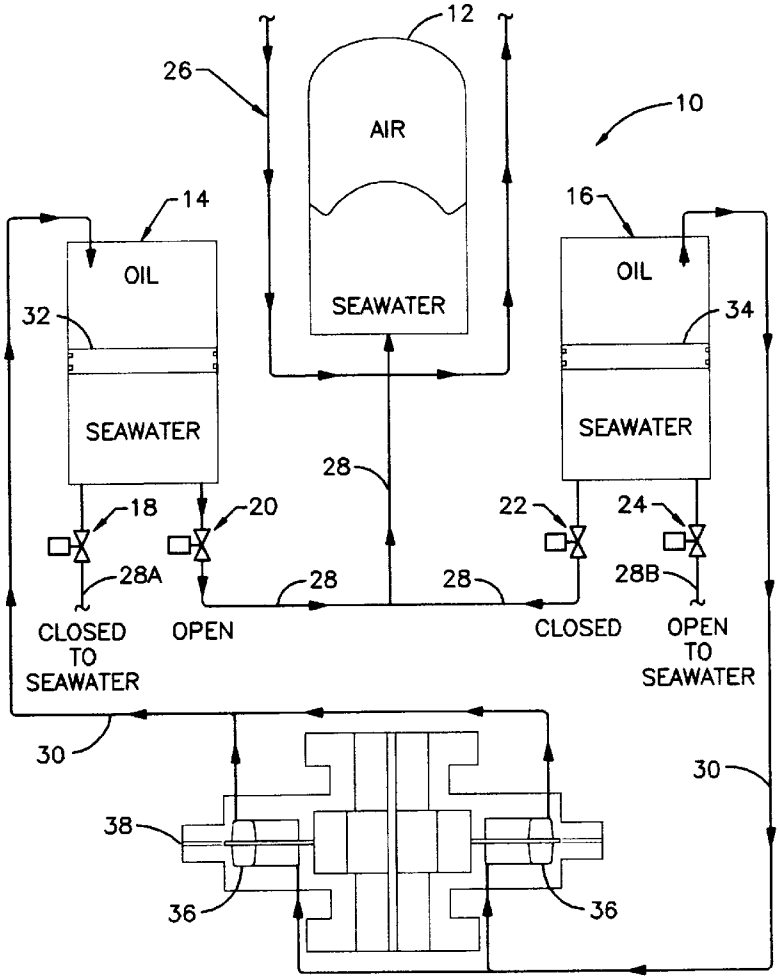
FIG. 3 is a schematic illustration of the invention that shows the valve configuration and flow required to close a blow out preventer.

The embodiment illustrated in FIGS. 1–3 is preferably designed for water depths of six thousand to ten thousand feet.

The first and second actuators 14, 16 are initially set up such that the pistons are substantially in the center of the containers. The lower portion of each actuator is filled with seawater. The upper portion of each actuator and hydraulic fluid lines 30 are filled with hydraulic fluid (oil). The reservoir 12 must first be charged with air at one atmosphere of pressure before operation. As illustrated in FIG. 1, this is accomplished by closing all of the solenoid valves 18, 20, 22, and 24 through the use of electrical controls connected to the valves and included in an umbilical line not shown. Solenoid valves and umbilical lines are generally known in the industry. Air is circulated through air line 26 to remove water from reservoir 12, then air line 26 is vented to atmospheric pressure. FIG. 1 illustrates the actuating mechanism 36 of the blow out preventer 38 in the open position. With all of the solenoid valves closed the subsea control module has no effect on the blow out preventer and maintains it in the current open or closed position (open as illustrated).

As illustrated in FIG. 2, the following operation is conducted in order to use the subsea power module to cause the blow out preventer to close. First and third solenoid valves 18 and 22 are opened. The ambient hydrostatic pressure causes water to enter the water side of the first actuator 14, moving piston 32 against the oil on the hydraulic fluid side of first actuator 14. This forces the oil to flow through hydraulic fluid line 30 to the blow out preventer 38 where the hydraulic fluid pressure causes the actuating mechanism 36 to close the blow out preventer. The hydraulic fluid in actuating mechanism 36 flows through the line 30 to the oil side of the second actuator 16. The pressure from the oil causes the piston 34 to move against the seawater. This forces the seawater to flow into the water line 28 and to vent into the reservoir 12 where it compresses the air. All solenoid valves may then be closed as illustrated in FIG. 1 to maintain the blow out preventer in the desired operating position.

As illustrated in FIG. 3, the following operation is conducted in order to use the subsea power module to cause the blow out preventer to open. The second and fourth solenoid valves 20 and 24 are opened. The ambient hydrostatic pressure causes water to enter the water side of the second actuator 16, moving piston 34 against the oil on the hydraulic fluid side of second actuator 16. This forces the oil to flow through hydraulic fluid line 30 to the blow out preventer 38 where the hydraulic fluid pressure causes the actuator mechanism 36 to open the blow out preventer. The hydraulic fluid in actuating mechanism 36 flows through the line 30 to the oil side of the first actuator 14. The pressure from the oil causes the piston 32 to move against the seawater. This forces the seawater to flow into the water line 28 and to vent into the reservoir 12 where it compresses the air. All solenoid valves may then be closed as illustrated in FIG. 1 to maintain the blow out preventer in the desired operating position.

Figure 4:
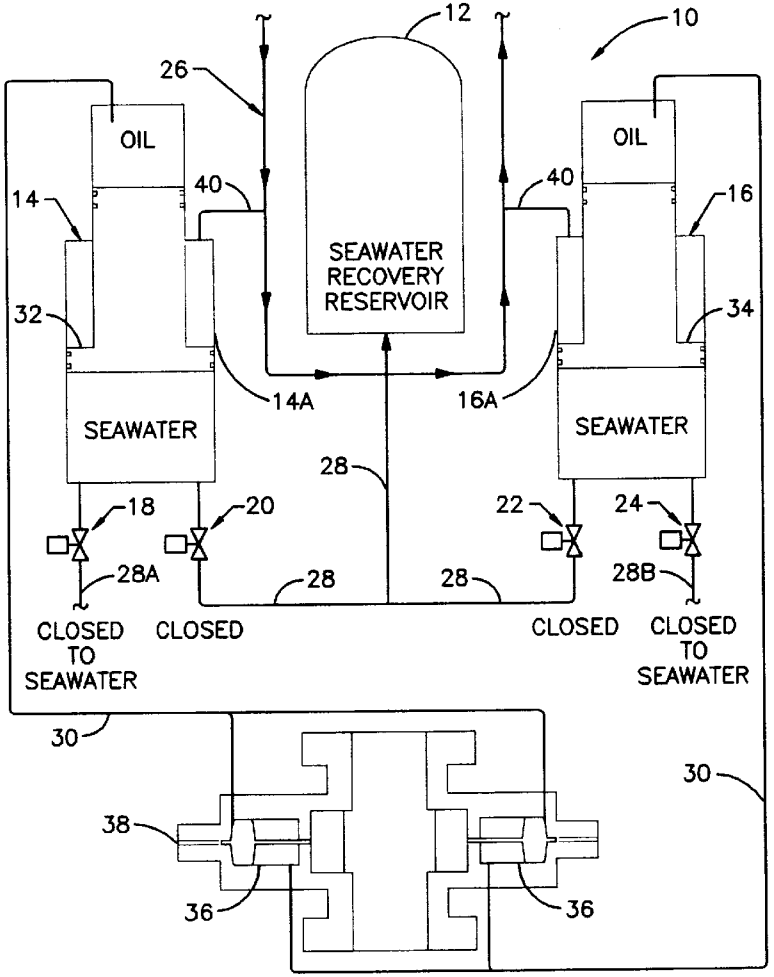
FIG. 4 is a schematic illustration of an alternate embodiment of the invention for relatively shallow water.

FIG. 4 illustrates an alternate embodiment of the invention for use in shallower water, two thousand to six thousand feet. The main difference from that described above is that the surface area of the pistons 32, 34 on the oil side of the actuators 14, 16 is greater than the surface area on the water side. This is necessary since the hydrostatic pressure is not as great at the shallower depths and the extra surface area is required in order to achieve the high oil pressure needed for closing blow out preventers.

This results in the containers that form the actuators having an upper oil-containing portion that has a smaller diameter than the lower water-containing portion. The pistons each have two sealing surfaces to prevent mixing of the fluids (a sealing surface in the narrower oil portion and a sealing surface in the wider water portion) . This essentially forms three potential chambers in the actuators when the pistons are in their middle neutral position as seen in FIG. 4. The lower portions 14A, 16A thus contain seawater both below and above the wider portion of the piston.

This results in the need for a means to relieve the seawater pressure above the wider portion in the actuators when the pistons are moved. Fluid lines 40 are provided to serve the purpose. For each actuator, a fluid line 40 is in fluid communication with the upper seawater portion of the actuator and the air line 26. This allows seawater to move between the actuators 14, 16 and the air line 26 as necessary during operation of the invention.

Figure 5:
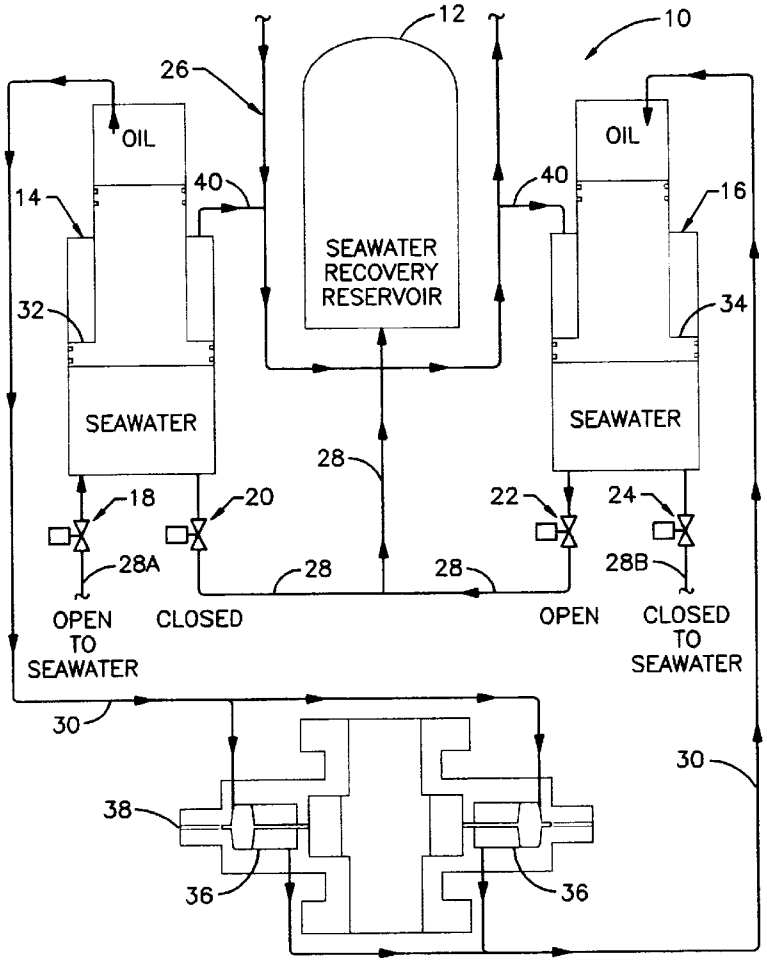
FIG. 5 is a schematic illustration of the alternate embodiment of the invention that shows the valve configuration and flow required to open a blow out preventer.

FIG. 5 illustrates the operation of the alternate embodiment to close the blow out preventer. The solenoid valve operation is the same as that described above relative to FIG. 2. The only difference in fluid flow is that seawater moves from the first actuator 14 into the air line 26 and from air line 26 into the second actuator 16.

Figure 6:
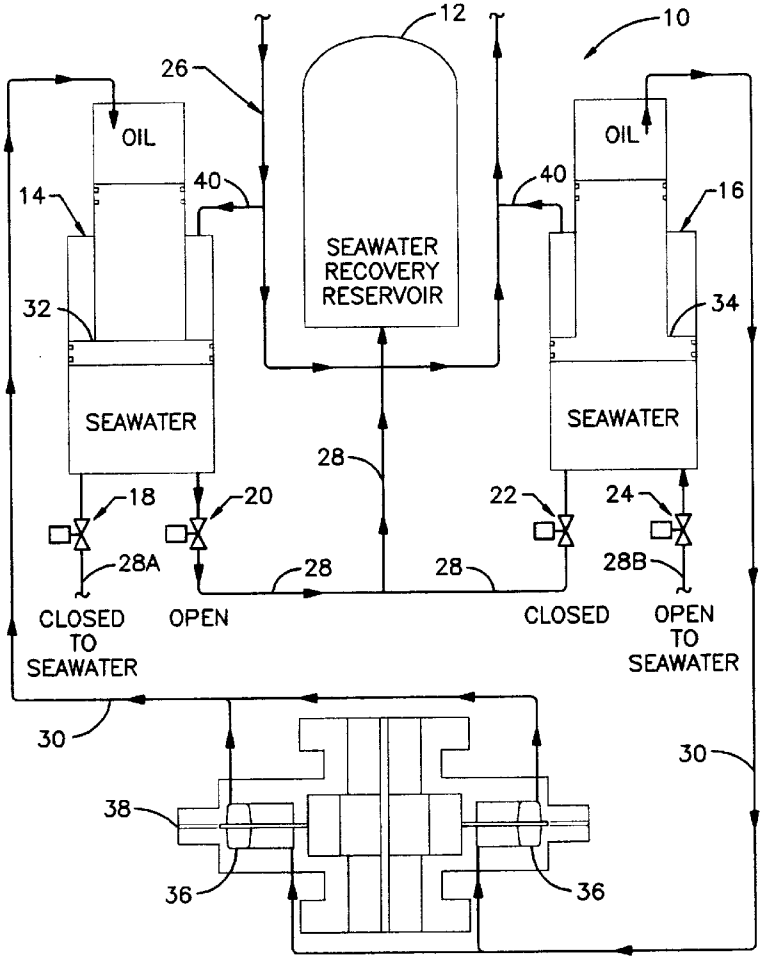
FIG. 6 is a schematic illustration of the alternate embodiment of the invention that shows the valve configuration and flow required to close a blow out preventer.

FIG. 6 illustrates the operation of the alternate embodiment to open the blow out preventer. The solenoid valve operation is the same as that described above relative to FIG. 3. The only difference in fluid flow is that seawater moves from the second actuator 16 into the air line 26 and from air line 26 into the first actuator 14.

The invention provides several advantages over the existing art. Hydraulic supply lines from the surface to the sea floor are eliminated. The invention does not release hydraulic fluid oil into the environment. The invention provides fast response times. The invention eliminates the large number of accumulators common in the existing art. The invention requires only a small control line bundle.

Although the drawings illustrate the invention in use with a blow out preventer, it should be understood that the invention could also be used for the control of any similar type of underwater drilling and production equipment.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. A subsea power module, comprising:

a. a seawater recovery reservoir;

b. an air line in fluid communication with said reservoir for supplying low pressure air to said reservoir and for removing water from said reservoir;

c. a first oil-over-water actuator;

d. a second oil-over-water actuator;

e. a water line providing fluid communication between the water sides of said first and second actuators, said reservoir, and said air line;

f. means in said water line for selectively controlling water flow to and from each of said actuators;

g. means for selectively opening the water side of each of said actuators to the surrounding hydrostatic water pressure;

h. a hydraulic fluid line providing fluid communication between the oil sides of said first and second actuators; and i. equipment in fluid communication with said hydraulic line whereby the operation of said equipment is controlled by the direction of hydraulic fluid flow through said hydraulic fluid line.

2. The subsea power module of claim 1, wherein said means for selectively opening the water side of each actuator comprises a solenoid valve.

3. The subsea power module of claim 1, where the oil and water sides of said actuators are separated by a movable piston.

* * * * *